US009671122B2

(12) United States Patent
McKie et al.

(10) Patent No.: US 9,671,122 B2
(45) Date of Patent: Jun. 6, 2017

(54) CONTROLLER EMPLOYING FEEDBACK DATA FOR A MULTI-STRIKE METHOD OF OPERATING AN HVAC SYSTEM AND MONITORING COMPONENTS THEREOF AND AN HVAC SYSTEM EMPLOYING THE CONTROLLER

(75) Inventors: Justin McKie, Frisco, TX (US); Eric Perez, Hickory Creek, TX (US); Greg Thomas, McKinney, TX (US)

(73) Assignee: Lennox Industries Inc., Richardson, TX (US)

( * ) Notice: Subject to any disclaimer, the term of this patent is extended or adjusted under 35 U.S.C. 154(b) by 988 days.

(21) Appl. No.: 13/326,044

(22) Filed: Dec. 14, 2011

(65) Prior Publication Data

US 2013/0158719 A1 Jun. 20, 2013

(51) Int. Cl.
*G05D 23/00* (2006.01)
*F24F 11/00* (2006.01)

(52) U.S. Cl.
CPC ..... *F24F 11/006* (2013.01); *F24F 11/0086* (2013.01); *F24F 2011/0063* (2013.01); *F24F 2011/0064* (2013.01); *F24F 2011/0093* (2013.01)

(58) Field of Classification Search
CPC ..... F24F 11/006; F24F 2011/0093; F24F 11/0086; F24F 2011/0064; F24F 2011/0063
USPC ..... 700/26, 50
See application file for complete search history.

(56) References Cited

U.S. PATENT DOCUMENTS

| | | | |
|---|---|---|---|
| 1,094,309 | A | 4/1914 | Daw |
| 3,252,508 | A | 5/1966 | Goettl |
| 3,889,742 | A | 6/1975 | Rush et al. |
| 4,018,266 | A | 4/1977 | Kay |
| 4,060,913 | A | 12/1977 | Yoshida et al. |
| 4,228,849 | A | 10/1980 | Heinola |
| 4,281,522 | A | 8/1981 | Bussjager |
| 4,342,359 | A | 8/1982 | Baker |
| 4,497,361 | A | 2/1985 | Hajicek |
| 4,611,653 | A | 9/1986 | Ikemura et al. |
| 4,727,931 | A | 3/1988 | Berner |
| 4,754,651 | A | 7/1988 | Shortridge et al. |
| 4,784,212 | A | 11/1988 | Brimer et al. |
| 4,825,936 | A | 5/1989 | Hoagland et al. |
| 4,834,004 | A | 5/1989 | Butuk et al. |

(Continued)

OTHER PUBLICATIONS

Ansi/Ahri Standard 1060, 2005 Standard for Performance Rating of Air-to-Air Exchangers for Energy Recovery Ventilation, 13 pages.

(Continued)

*Primary Examiner* — Charles Kasenge
(74) *Attorney, Agent, or Firm* — Baker Botts L.L.P.

(57) ABSTRACT

A controller for an HVAC system, a compute-usable medium and an ERV are disclosed. In one embodiment, the controller includes: (1) an input terminal configured to receive feedback data from a first operating unit of the HVAC system, (2) an operation monitor configured to determine if the feedback data corresponds to a predetermined condition for the first operating unit and (3) a system director configured to operate a second operating unit of the HVAC system at a predetermined operating value corresponding to the predetermined condition and a number of occurrences of predetermined conditions associated with the first operating unit.

18 Claims, 7 Drawing Sheets

(56) References Cited

U.S. PATENT DOCUMENTS

| | | | | |
|---|---|---|---|---|
| 4,841,733 | A | 6/1989 | Dussault et al. | |
| 4,843,838 | A | 7/1989 | Trask | |
| 4,854,726 | A | 8/1989 | Lesley et al. | |
| 4,873,649 | A | 10/1989 | Grald et al. | |
| 5,062,280 | A | 11/1991 | Martin, Sr. | |
| 5,069,272 | A | 12/1991 | Chagnot | |
| 5,173,922 | A | 12/1992 | Arakawa et al. | |
| 5,183,098 | A | 2/1993 | Chagnot | |
| 5,238,052 | A | 8/1993 | Chagnot | |
| 5,316,073 | A * | 5/1994 | Klaus et al. | 165/11.1 |
| 5,372,182 | A | 12/1994 | Gore | |
| 5,376,045 | A | 12/1994 | Kiser | |
| 5,423,187 | A | 6/1995 | Fournier | |
| 5,482,108 | A | 1/1996 | Essle et al. | |
| 5,497,823 | A | 3/1996 | Davis | |
| 5,515,909 | A | 5/1996 | Tanaka | |
| 5,564,626 | A | 10/1996 | Kettler et al. | |
| 5,726,424 | A | 3/1998 | Koether | |
| 5,728,289 | A | 3/1998 | Kirchnavy et al. | |
| 5,761,908 | A | 6/1998 | Oas et al. | |
| 5,826,641 | A | 10/1998 | Bierwirth et al. | |
| 5,839,096 | A | 11/1998 | Lyons et al. | |
| 5,927,096 | A | 7/1999 | Piccione | |
| 6,009,763 | A | 1/2000 | Berckmans et al. | |
| 6,039,109 | A | 3/2000 | Chagnot et al. | |
| 6,209,622 | B1 | 4/2001 | Lagace et al. | |
| 6,223,544 | B1 | 5/2001 | Seem | |
| 6,289,974 | B1 | 9/2001 | DeGregoria et al. | |
| 6,328,095 | B1 | 12/2001 | Felber et al. | |
| 6,355,091 | B1 | 3/2002 | Felber et al. | |
| 6,415,616 | B1 | 7/2002 | Kim | |
| 6,575,228 | B1 | 6/2003 | Ragland et al. | |
| 6,672,627 | B1 | 1/2004 | Mariman et al. | |
| 6,776,708 | B1 | 8/2004 | Daoutis et al. | |
| 6,880,619 | B1 | 4/2005 | Suzukawa et al. | |
| 6,925,999 | B2 | 8/2005 | Hugghins et al. | |
| 6,929,057 | B1 | 8/2005 | Sahota et al. | |
| 7,012,516 | B2 | 3/2006 | Laurosch et al. | |
| 7,073,566 | B2 | 7/2006 | Lagace | |
| 7,090,000 | B2 | 8/2006 | Taylor | |
| 7,100,634 | B2 | 9/2006 | Robb et al. | |
| 7,231,967 | B2 | 6/2007 | Haglid | |
| 7,308,384 | B2 | 12/2007 | Shah et al. | |
| 7,440,864 | B2 | 10/2008 | Otto | |
| 7,458,228 | B2 | 12/2008 | Lagace et al. | |
| 7,716,936 | B2 | 5/2010 | Bailey et al. | |
| 7,841,381 | B2 * | 11/2010 | Chagnot et al. | 165/8 |
| 7,856,289 | B2 | 12/2010 | Schanin et al. | |
| 7,886,986 | B2 * | 2/2011 | Fischer et al. | 236/49.3 |
| 8,123,518 | B2 | 2/2012 | Nordberg et al. | |
| 2002/0139514 | A1 | 10/2002 | Lagace et al. | |
| 2002/0153133 | A1 | 10/2002 | Haglid | |
| 2003/0085814 | A1 | 5/2003 | Griep | |
| 2003/0140638 | A1 | 7/2003 | Arshansky et al. | |
| 2003/0178411 | A1 | 9/2003 | Manganiello et al. | |
| 2004/0155466 | A1 | 8/2004 | Sodemann et al. | |
| 2005/0236150 | A1 | 10/2005 | Chagnot et al. | |
| 2005/0252229 | A1 | 11/2005 | Moratalla | |
| 2006/0035580 | A1 | 2/2006 | Anderson et al. | |
| 2006/0054302 | A1 | 3/2006 | Cho et al. | |
| 2006/0219381 | A1 | 10/2006 | Lagace et al. | |
| 2007/0012052 | A1 * | 1/2007 | Butler et al. | 62/181 |
| 2007/0045439 | A1 | 3/2007 | Wolfson | |
| 2007/0045601 | A1 | 3/2007 | Rhee | |
| 2007/0144187 | A1 | 6/2007 | Lee | |
| 2007/0171647 | A1 | 7/2007 | Artwohl et al. | |
| 2007/0205297 | A1 | 9/2007 | Finkam et al. | |
| 2007/0234748 | A1 | 10/2007 | Alvord et al. | |
| 2008/0017347 | A1 | 1/2008 | Chung et al. | |
| 2008/0033599 | A1 | 2/2008 | Aminpour et al. | |
| 2008/0076346 | A1 | 3/2008 | Ahmed | |
| 2008/0144238 | A1 | 6/2008 | Cline et al. | |
| 2008/0208531 | A1 | 8/2008 | Felcman et al. | |
| 2008/0223051 | A1 * | 9/2008 | Kates | F24F 3/1603 62/129 |
| 2008/0282494 | A1 | 11/2008 | Won et al. | |
| 2009/0032604 | A1 | 2/2009 | Miller | |
| 2009/0090117 | A1 | 4/2009 | McSweeney | |
| 2009/0095096 | A1 | 4/2009 | Dean et al. | |
| 2009/0120111 | A1 | 5/2009 | Taras et al. | |
| 2009/0156966 | A1 | 6/2009 | Kontschieder et al. | |
| 2009/0165644 | A1 * | 7/2009 | Campbell | 95/25 |
| 2009/0215375 | A1 | 8/2009 | Hagensen | |
| 2009/0222139 | A1 | 9/2009 | Federspiel | |
| 2010/0262298 | A1 | 10/2010 | Johnson et al. | |
| 2013/0087302 | A1 | 4/2013 | McKie et al. | |
| 2013/0090051 | A1 | 4/2013 | McKie et al. | |
| 2013/0090769 | A1 | 4/2013 | McKie et al. | |
| 2013/0092344 | A1 | 4/2013 | McKie et al. | |
| 2013/0092345 | A1 | 4/2013 | McKie et al. | |
| 2013/0092346 | A1 | 4/2013 | McKie et al. | |
| 2013/0095744 | A1 | 4/2013 | McKie et al. | |
| 2013/0118188 | A1 | 5/2013 | McKie et al. | |

OTHER PUBLICATIONS

Lennox Engineering Data, Indoor Air Quality ERV Energy Recovery Ventilator 60 HZ, Bulletin No. 210245, Mar. 2010, 20 pages.

* cited by examiner

CONTROLLER EMPLOYING FEEDBACK DATA FOR A MULTI-STRIKE METHOD OF OPERATING AN HVAC SYSTEM AND MONITORING COMPONENTS THEREOF AND AN HVAC SYSTEM EMPLOYING THE CONTROLLER

CROSS-REFERENCE TO RELATED APPLICATION

This application is related to U.S. application Ser. No. 13/267,441, by Justin McKie et al., entitled "METHODS OF OPERATING AN HVAC SYSTEM, AN HVAC SYSTEM AND A CONTROLLER THEREFOR EMPLOYING A SELF-CHECK SCHEME AND PREDETERMINED OPERATING PROCEDURES ASSOCIATED WITH OPERATING UNITS OF AN HVAC SYSTEM," filed on Oct. 6, 2011, commonly assigned with this application and incorporated herein by reference in its entirety.

TECHNICAL FIELD

This application is directed, in general, to climate control systems, and, more specifically, to operating such systems.

BACKGROUND

Heating, ventilating and air conditioning (HVAC) systems can be used to regulate the environment within an enclosed space. Typically, an air blower is used to pull air from the enclosed space into the HVAC system through ducts and push the air back into the enclosed space through additional ducts after conditioning the air (e.g., heating, cooling or dehumidifying the air). Various types of HVAC systems may be used to provide conditioned air for enclosed spaces. For example, some HVAC units are located on the rooftop of a commercial building. These so-called rooftop units, or RTUs, typically include one or more blowers and heat exchangers to heat and/or cool the building, and baffles to control the flow of air within the RTU. Some RTUs also include an air-side economizer that allows to selectively provide fresh outside air to the RTU or to recirculate exhaust air from the building back through the RTU to be cooled or heated again.

When the enthalpy of the fresh air is less than the enthalpy of the recirculated air, conditioning the fresh air may be more energy-efficient than conditioning the recirculated air. In this case the economizer may exhaust a portion of the stale air and replace the vented air with outside air. When the outside air is both sufficiently cool and sufficiently dry it may be possible that no additional conditioning of the outside air is needed. In this case the economizer may draw a sufficient quantity of outside air into the building to provide all the needed cooling. In some installations an energy recovery ventilator (ERV) may be used to pre-condition the fresh air demanded by the RTU. The ERV may include, e.g., an enthalpy exchange zone to transfer heat and/or humidity between an incoming fresh air stream and an outgoing exhaust air stream. The enthalpy exchange zone can include one or multiple enthalpy wheels. ERVs are typically equipped with fresh-air and return air filters that allow energy recovery from areas, such as kitchens and smoking area, that have a high level of contaminants but can still benefit from fresh-air. As such, using filters, even in areas with low contaminant levels, reduces the need for cleaning an enthalpy wheel according to a typical maintenance/service plan.

Thus, RTUs and HVAC systems in general have been improved with various options, such as an ERV, to provide higher efficiency and better comfort. Accordingly, HVAC systems have typically become more complex resulting in a cost increase for installation and service.

SUMMARY

One aspect provides a controller for a heating, ventilating and cooling (HVAC) system. In one embodiment, the controller includes: (1) an input terminal configured to receive feedback data from a first operating unit of the HVAC system, (2) an operation monitor configured to determine if the feedback data corresponds to a predetermined condition for the first operating unit and (3) a system director configured to operate a second operating unit of the HVAC system at a predetermined operating value corresponding to the predetermined condition and a number of occurrences of predetermined conditions associated with the first operating unit.

In another aspect, a computer-usable medium having non-transitory computer readable instructions stored thereon for execution by a processor to perform a method for operating an HVAC system is provided. In one embodiment, the computer-usable medium includes: (1) receiving feedback data from a first operating unit of the HVAC system, (2) determining if the feedback data corresponds to a predetermined condition for the first operating unit and (3) operating a second operating unit of the HVAC system at a predetermined operating value corresponding to the predetermined condition and a number of occurrences of predetermined conditions associated with the first operating unit.

In still another aspect, an energy recovery ventilator (ERV) is disclosed. In one embodiment, the ERV includes: (1) a filter, (2) an enthalpy wheel, (3) a fan that moves air through the filter and the enthalpy wheel and (4) a controller. The controller includes: (4A) a first input terminal configured to receive feedback data corresponding to the air moving through the filter, (4B) an operation monitor configured to determine if the feedback data corresponds to a filter predetermined condition for the filter and (4C) a system director configured to operate the fan at a filter predetermined operating value corresponding to the filter predetermined condition and a number of occurrences of filter predetermined conditions associated with the filter.

BRIEF DESCRIPTION

Reference is now made to the following descriptions taken in conjunction with the accompanying drawings, in which.

DETAILED DESCRIPTION

Figure 1:
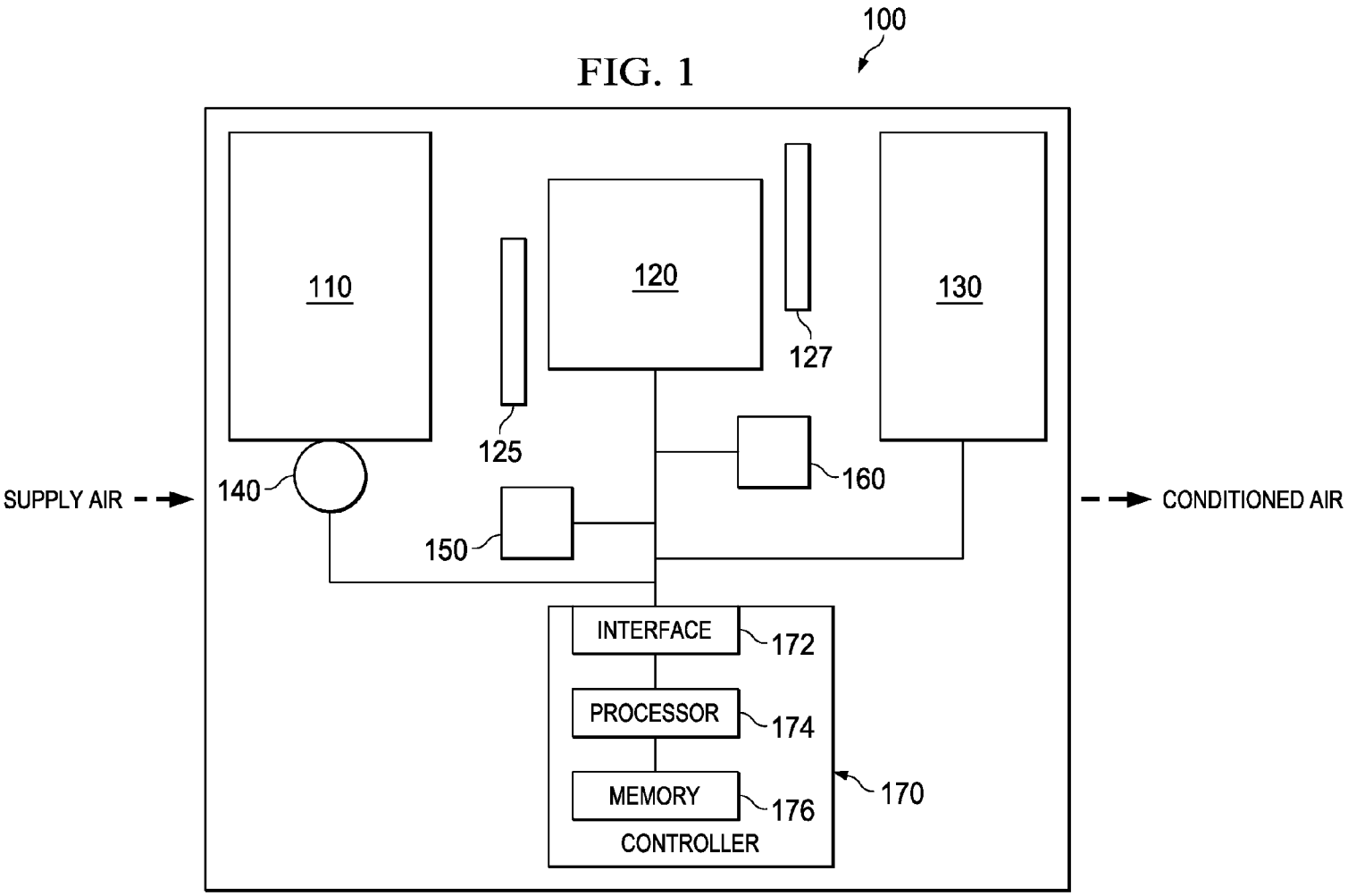
FIG. 1 illustrates a block diagram of an embodiment of an HVAC system constructed according to the principles of the disclosure.

A portion of the cost increase associated with servicing improved HVAC systems, such as an ERV, corresponds to the additional components, such as air filters, that support or enhance the operation of the ERV. Inspecting and/or replacing air filters in HVAC systems are typically done within a regular maintenance plan. When inspecting, customers and/or technicians can estimate the remaining filter life of an air filter and can reschedule maintenance to coincide when needed.

Some time HVAC systems are either intentionally or negligently operated without air filters. Nevertheless, if customers forego employing air filters, components, such as enthalpy wheels, can become contaminated with tar and/or grease or smoke particulates. A dirty enthalpy wheel can reduce fresh-air into a building, increase pressure drop through the enthalpy wheel, increase ERV energy usage and reduce the total energy of recovery. If the filters and/or enthalpy wheel are not maintained, then an ERV may shut down the system to prevent damage or generate a signal to alert a customer that care is needed. As such, clients may not be able to take full advantage of their investment.

The disclosure, therefore, provides a scheme that intelligently and safely extends operation of an HVAC system, even when a field maintenance plan is inadequate. The operation scheme determines if a predetermined condition exists for a first operating unit of an HVAC system based on feedback data from the HVAC system and operates another operating unit of the HVAC system at a predetermined operating value corresponding to the predetermined condition and a number of occurrences of predetermined conditions associated with the first operating unit. For example, in one embodiment the HVAC system is an ERV that determines when a dirty filter condition and/or a dirty enthalpy wheel condition exists and take specific actions to maintain the supply of fresh air into a building and optimize effectiveness of the ERV during the period when filtration media needs to be changed and/or enthalpy wheels need to cleaned. Thus, in contrast to some conventional units, the disclosed HVAC systems provide at least some benefit of their investment to clients even when maintenance needs to be performed.

Additionally, in one embodiment the disclosed schemes employ the feedback data to detect that an air filter is indeed installed in an HVAC system. The feedback data can also be employed to determine if a blower is operating. Furthermore, in some embodiments disclosed herein the feedback data is employed to determine a filter life value (e.g., a remaining life of a filter).

In some embodiments, at least part of the feedback data is provided by one or more digital pressure sensors. In other embodiments, at least some of the feedback data is provided by one or more pressure transducers. A digital pressure sensor is an on/off diaphragm switch that is operated when detecting a set pressure value. A digital pressure sensor can be set at a low operating value and used to detect, for example, the installation of an air filter, if a blower is operating and the filter life value. In some embodiments, the low operating value is factory set to 0.15 inches of water column and field adjustable for such instances as when HVAC units are operating at an airflow value that is significantly lower and/or higher than typical filter velocities.

In contrast, a pressure transducer is a differential pressure switch with two ports that indicates the pressure drop across the ports. The cost of a digital pressure sensor, such as a MPL9370A diaphragm switch by Micro Pneumatic Logic, can be twenty fives times less the cost of a differential pressure transducer, such as a Series 616C-1 Pressure Transmitter by Dwyer Instruments, Inc. Both a digital pressure sensor and a pressure transducer both provide feedback data and are collectively referred to herein as pressure sensors. Embodiments may include both types of pressure sensors to provide the feedback data or only one type.

The feedback data represents operating data of an HVAC system. In some embodiments, the feedback data is an electrical signal or signals that represent a pressure at a location of the HVAC system or represent a pressure difference at a location of the HVAC system. Input terminals of a controller may be designated to receive specific feedback data. As such, in some embodiments the controller can determine the existence of a predetermined condition based upon receipt of feedback data at a designated input terminal.

Operating units of an HVAC system are operating members of the HVAC system that perform a designated function. Operating units include, for example, sensors and components of an HVAC system. In one embodiment, an ERV is disclosed that has operating units including components and sensors. The components can be, for example, moving components such as an intake blower, an exhaust blower and an enthalpy wheel. In some embodiments, the sensors are pressure sensors or pressure switches.

FIG. 1 illustrates a block diagram of an embodiment of an HVAC system 100 constructed according to the principles of the disclosure. The HVAC system 100 is configured to receive supply air and process the air to provide conditioned air for a structure such as a building. The supply air may be recirculated air. The HVAC system 100 may be a residential or commercial unit. In one embodiment, the HVAC system 100 is an RTU or part of an RTU for a commercial installation. For example, the HVAC system 100 may be an ERV associated with an RTU.

The HVAC system 100 includes multiple operating units and a controller 170. Operating units 110, 120 and 130 are components that move and/or condition air for a structure. For example, in one embodiment the HVAC system 100 is an ERV and operating unit 110 is an intake blower, operating unit 120 is an enthalpy wheel and operating unit 130 is an exhaust blower. Air filter 125 and air filter 127 are associated with the operating units 110, 120 and 130. In one embodiment, the air filter 125 is an intake filter for the operating unit 120 and the air filter 127 is exhaust filter of the operating unit 120.

Operating units 140, 150 and 160 are sensors that are used to monitor the operation of the HVAC system 100. For example, operating unit 140 may be a sensor used to detect the operating speed of an intake blower, operating unit 110. In one embodiment, the operating units 150 and 160 are pressure sensors that provide feedback data to the controller 170. In this embodiment, the feedback data represents the air pressure in different locations within the HVAC system 100. The controller 170 is configured to employ feedback data from the sensors to determine if a predetermined condition exists. For example, the air filters 125, 127, can be intake and exhaust air filters, respectively, associated with the enthalpy wheel operating unit 120 and the operating units 150 and 160 are pressure sensors. Operating unit 150 provides feedback data that indicates the air pressure across the filter 125. Operating unit 160 provides feedback data that indicates the air pressure across the filter 127. The controller 170 receives the feedback data and determines if the pressure across a filter has reached a predetermined condition or one of multiple predetermined conditions. The predetermined condition can be associated with an operating set point and correspond to or be a dirty filter and/or a degree of a dirty filter. In other embodiments, at least one of the operating units 150 and 160 may be pressure sensors that are used to indicate a pressure across the enthalpy wheel operating unit 120. Other predetermined conditions include, for example, a filter life value, an installed filter and an operating blower.

The controller 170 is configured to direct the operation of the HVAC system 100. As such, the controller 170 is configured to generate control signals that are transmitted to the various operating units (e.g., components) to direct the operation thereof. The controller 170 may generate the control signals in response to feedback data that is received from the various sensors and/or components (i.e., operating units) of the HVAC system 100. The controller 170 includes an interface 172 that is configured to receive and transmit the feedback data and control signals. The interface 172 may be a conventional interface that is used to communicate (i.e., receive and transmit) data for a controller, such as a microcontroller. The controller 170 may also include additional components typically included within a controller for a HVAC unit, such as a power supply or power port.

The interface 172 may include at least one designated input terminal that is configured to receive feedback data from a particular operating unit. In one embodiment, a first input terminal is configured to received feedback data from the operating unit 150 and a second input terminal is configured to receive feedback data from the operating unit 160. A third input terminal may be configured to receive feedback data associated with the pressure drop across the enthalpy wheel operating unit 120.

The controller 170 also includes a processor 174 and a memory 176. The memory 176 may be a conventional memory typically located within a microcontroller that is constructed to store data and computer programs. The memory 176 may store operating instructions to direct the operation of the processor 174 when initiated thereby. The operating instructions may correspond to algorithms that provide the functionality of the operating schemes disclosed herein. For example, the operating instructions may correspond to the algorithms that implement the methods illustrated in FIG. 5, FIG. 6 and FIG. 7. The processor 174 may be a conventional processor such as a microprocessor. The interface 172, processor 174 and memory 176 may be coupled together via conventional means to communicate information.

The controller 170 is configured to receive feedback data from a first operating unit, such as from the operating units 110, 120, 130, 140, 150 and 160, determine if feedback data corresponds to a predetermined condition for the operating unit and operate a second operating unit at a predetermined operating value corresponding to the predetermined condition and a number of occurrences of predetermined conditions associated with the first operating unit. The controller 170 may generate and transmit control signals to the second operating unit to distinctly operate the unit according to the predetermined operating value. Accordingly, the second operating unit can be operated at a reduced capacity in response to the feedback data. The reduced capacities may vary for the different operating units and can be determined via comparison to predetermined sets of operating parameters.

A predetermined condition is a defined condition that occurs when a designated operating value, as represented by feedback data, corresponds to a pre-set value or set point. For example, the pre-set value of a pressure drop of one and a quarter inch (1¼") of water column is established and associated with the defined condition of a dirty filter. When feedback data indicates an operating pressure drop across a filter of one and a quarter inch of water column, then the predetermined condition of a dirty filter exists. Other predetermined conditions, such as a dirty enthalpy wheel or enthalpy exchange zone may be similarly identified. Multiple predetermined conditions and corresponding pre-set values may be defined for a single component of an HVAC system.

Predetermined operating values are pre-set operating values for particular components of an HVAC system that correspond to a predetermined condition. Continuing the example above, after a predetermined condition is determined, the controller 170 directs a blower of the HVAC system 100 (either intake or exhaust) to operate at a reduced capacity represented by a predetermined operating value. Operating the blower at the reduced capacity lowers the pressure across the dirty filter and allows HVAC system 100 to still operate.

Figure 2:
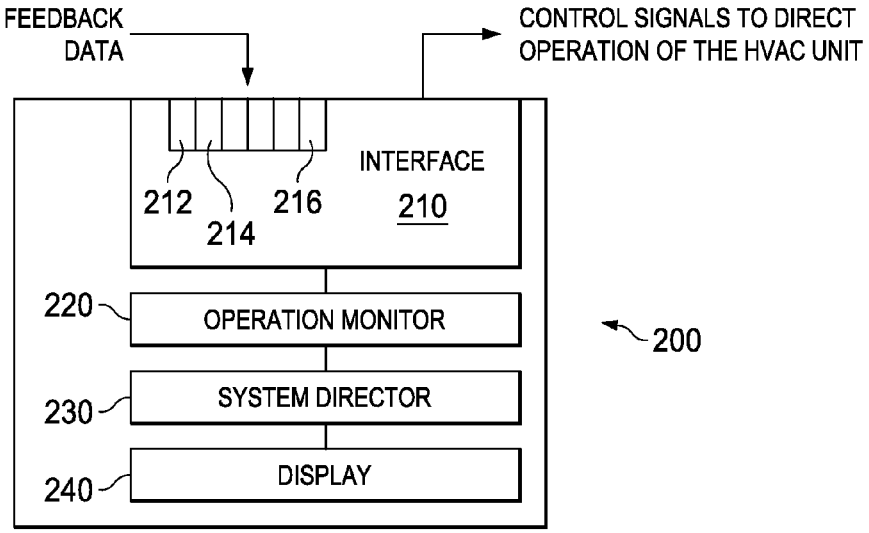
FIG. 2 illustrates a block diagram of an embodiment of a controller constructed according to the principles of the disclosure.

In addition to the operation schemes disclosed herein, the controller 170 can be configured to provide control functionality beyond the scope of the present disclosure. FIG. 2 provides more detail of an HVAC controller constructed according to the disclosure.

FIG. 2 illustrates a block diagram of an embodiment of an HVAC controller 200 constructed according to the principles of the disclosure. The controller 200 is configured to receive feedback data from an operating unit or units of an HVAC system and direct operation of the HVAC system based thereon. The HVAC controller 200 includes an interface 210, an operation monitor 220, a system director 230 and a display 240. At least a portion of the operation monitor 220 and/or the system director 230 may be implemented in a processor and/or a memory of the controller 200. The display 240 is a conventional display.

The interface 210 is configured to receive feedback data from operating units of an HVAC system and transmit control data to the operating units. The HVAC system may be, for example, the HVAC system 100 of FIG. 1 or the HVAC system 400 of FIG. 4. The interface 210 may be a conventional interface typically employed in HVAC controllers to receive and transmit data either wirelessly or hardwired.

The interface 210 includes input terminals that are specifically designated to receive feedback data. Three input terminals, 212, 214 and 216, are specifically designated to receive feedback data from a first filter, an enthalpy exchange zone, and a second filter, respectively. One skilled in the art will understand that the interface 210 may not include each of the designated input terminals or may include more designated input terminals. In one embodiment, the HVAC system does not include an enthalpy exchange zone. In such an embodiment, the interface 120 may not include an input terminal designated to receive feedback data associated with an enthalpy exchange zone.

The operation monitor 220 is configured to determine if received feedback data corresponds to a predetermined condition for a first operating unit of the HVAC system. In one embodiment, the operation monitor 220 compares the feedback data to a pre-set operating value to determine if a predetermined condition exists for the first operating unit. The pre-set operating values can be stored in a memory of the controller 200. In one embodiment the pre-set operating values are stored in a table of the memory.

In addition to receiving feedback data from one operating unit, the operation monitor 220 may employ feedback data from multiple operating units to determine the existence of a predetermined condition. In some embodiments, the operation monitor 220 is configured to perform a calculation or calculations to determine if feedback data corresponds to a predetermined condition. The operation monitor 220 can employ fan law equations, such as a cubic feet per minute (CFM) versus static pressure equation, for determining a predetermined condition. Additionally, for these calculations, low cost digital pressure switches set at low values can be used to determine predetermined conditions and to build an operating model of the HVAC system.

For example, to determine a dirty filter or dirty wheel condition, the operation monitor 220 can employ equation 1:

$$CFM1/CFM2=(P1/P2)\hat{}0.5. \quad \text{(Equation 1)}$$

From this equation, the operation monitor 220 solves for the air-flow that will result in P2=1.25 inches of water column drop across a filter or enthalpy exchange zone. This pressure differential of 1.25 inches water column is considered by many manufacturers to signify a pressure drop that corresponds to a hundred percent usage for a filter or enthalpy wheel that needs to be cleaned. One skilled in the art will understand the pre-set operating value for the dirty filter or wheel predetermined condition can also be a variable that is factory/field configurable.

Considering a dirty filter condition, in equation 1, P1 is a pressure value for a filter digital pressure switch, CFM1 is ramp up CFM that resulted in closing the filter digital pressure switch, CFM2 is a set point for an ERV and/or RTU blower, that is the target air-flow once the blowers are running at the correct speed (normal operating speed). P2 is a calculated value. Whenever the calculated value for P2>=1.25 in water column, then the operation monitor 220 will register this as a "dirty filter strike" and reduce a set blower speed by a set amount, such as by 10%.

P1 can be set at a low set point of or about 0.20 inch water column. At this value, the filter pressure switch (e.g., operating unit 150 of FIG. 1) can be used to verify operation of an HVAC blower since it should trip at this low value if a blower is blowing. Additionally, the filter pressure switch at this value can be used to determine if filter is actually installed since it will not trip if one is not installed.

The operation monitor 220 is also configured to determine the filter life value. Equation 2 below can be used to calculate the filter life value.

$$\text{Filter Life } \%=CFM1/CFM2. \quad \text{(Equation 2)}$$

HVAC blowers ramp up slowly from start-up to CFM2. In, or about, 30-45 seconds, this allows time for the HVAC system to establish and/or calculate the air-flow required to close the filter switch. The operation monitor 220 is configured to record the speed of a blower when the filter pressure switch closes. Commissioning data can be input as a reference point to determine the filter life value. By employing low cost digital pressure switches and employing the feedback data provided thereby, in some embodiments the operation monitor 220 can intelligently and inexpensively calculate various values to determine predetermined conditions as an alternative to using more expensive pressure transducers.

The system director 230 is configured to operate a second operating unit of the HVAC system at a predetermined operating value corresponding to the predetermined condition and a number of occurrences of predetermined conditions associated with the first operating unit. In some embodiments, the second operating unit is a blower of an HVAC system, such as an intake or an exhaust blower. By reducing the capacity of a blower, the pressure across a filter or enthalpy exchange zone can be reduced. In one embodiment, the predetermined operating value reduces an operating capacity of the second operating unit. In some embodiments, the operating capacity is reduced to a first limited operating value when the number of occurrences is equal to one and reduced to a second limited operating value when the number of occurrences is equal to two. Additionally, the predetermined operating value can prevent operation of the second operating unit.

Figure 3:
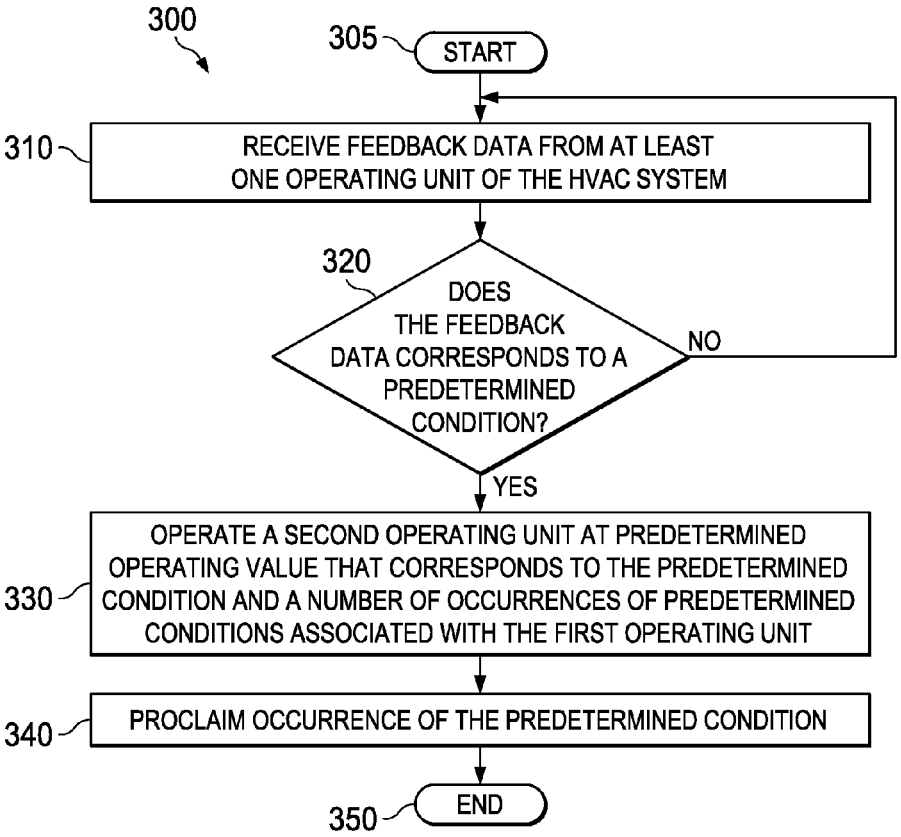
FIG. 3 illustrates a flow diagram of an embodiment of a method of operating an HVAC system carried out according to the principles of the disclosure.

FIG. 3 illustrates a flow diagram of an embodiment of a method 300 of operating an HVAC system carried out according to the principles of the disclosure. The HVAC system may be a RTU that includes a refrigeration circuit, an intake blower, an exhaust blower and a heating element. Additionally, the RTU may have an associated ERV. An HVAC controller such as described with respect to FIG. 1 or FIG. 2 may be used to perform the method 300. A portion of the method 300 may represent an algorithm that is stored on a computer readable medium, such as a memory of an HVAC controller (e.g., the memory 176 of FIG. 1), as a series of operating instructions that can direct the operation of a processor (e.g., the processor 174 of FIG. 1). The method 300 begins in a step 305 at the start-up of an HVAC system.

In a step 310, feedback data is received from a first operating unit of the HVAC system. The feedback data is received at an input of the controller. In one embodiment, the operating unit is a pressure sensor.

A determination is made in a decisional step 320 if the feedback data corresponds to a predetermined condition for the first operating unit. If not, the method 300 continues to step 310 and waits to receive feedback data.

If the feedback data corresponds to a predetermined condition, the method 300 continues to a step 330 where a second operating unit of the HVAC system is operated at a predetermined operating value corresponding to the predetermined condition and a number of occurrences of predetermined conditions associated with the first operating unit. If a single predetermined condition has occurred, then the second operating unit may be operated at a reduced capacity of 10% from the original set point. If a second predetermined condition has occurred (two strikes), the second operating unit may be operated at 20% reduced capacity of the original set point.

In a step 340, occurrence of the predetermined condition is proclaimed. In one embodiment, an alarm signal is automatically sent to a building monitoring station. In some embodiments, the occurrence is also visually output as an error condition on a display of the controller. The method 300 ends in a step 350.

Figure 4:
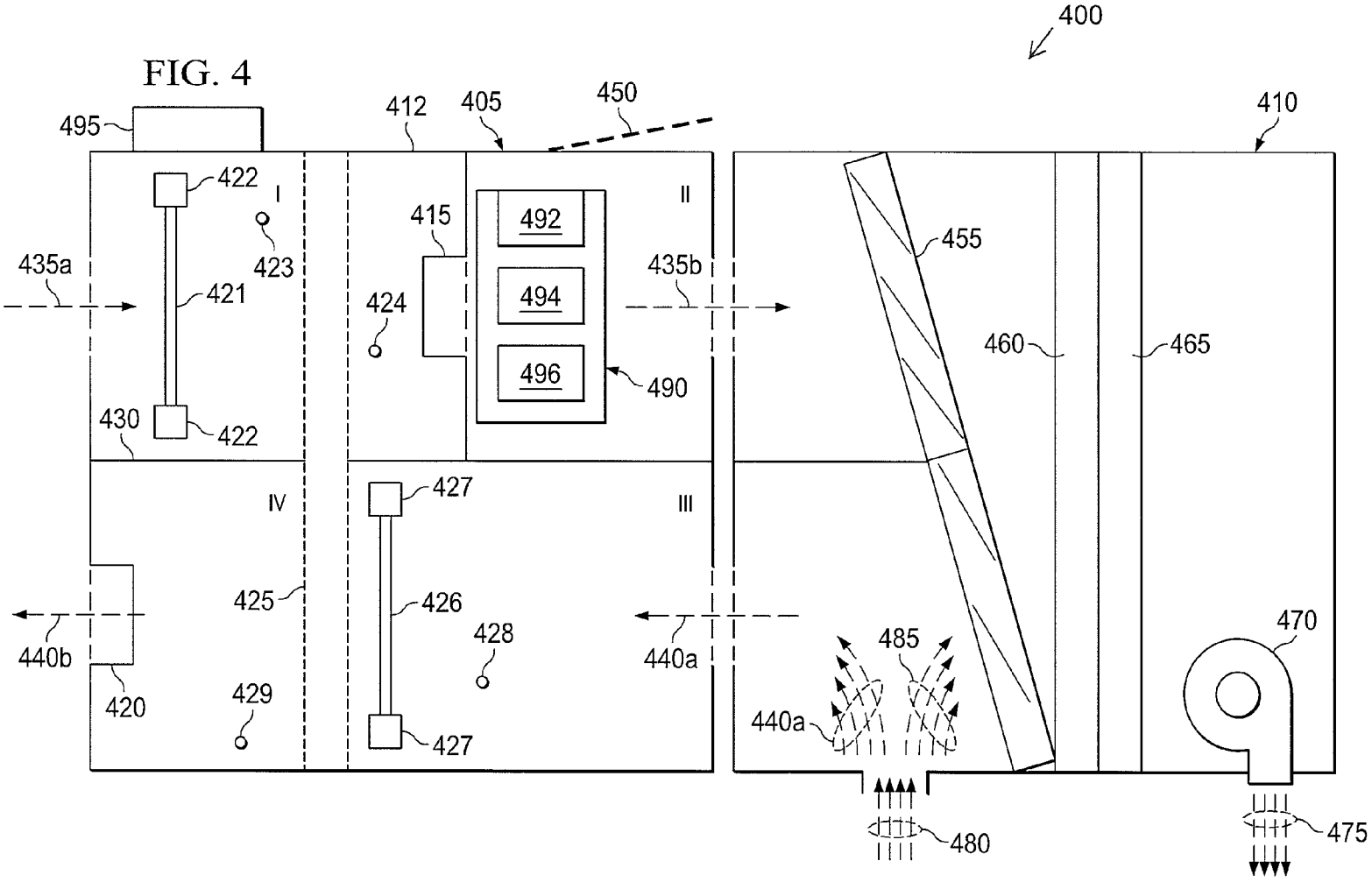
FIG. 4 illustrates a block diagram of an embodiment of an HVAC system, including an ERV, constructed according to principles of the disclosure.

FIG. 4 illustrates a block diagram of an embodiment of an HVAC system 400 constructed according to principles of the disclosure. The system 400 includes an ERV 405 and an RTU 410. While the embodiment of the system 400 is discussed in the context of a RTU, the scope of the disclosure includes other HVAC applications that are not roof-top mounted.

The ERV 405 includes an enclosure (e.g. a cabinet) 412, first and second variable speed blowers 415 and 420, an enthalpy exchange zone 425 and a divider 430. The blowers 415, 420 may be of any conventional or novel type, such as radial or axial, impeller- or propeller-types. The blowers 415 and 420 as illustrated are configured in a pull-pull configuration, but embodiments of the system 400 are not limited thereto. The enthalpy exchange zone 425 may also be conventional or novel and include at least one enthalpy wheel. Without limitation to any particular type of enthalpy wheel, those skilled in the pertinent art will appreciate that enthalpy wheels typically include a heat and/or moisture transfer medium that provides a semi-permeable barrier for air to flow there through. In some embodiments, multiple enthalpy wheels are included and the area is referred to as an enthalpy exchange zone.

In the illustrated embodiment the enthalpy exchange zone 425 and the divider 430 divide the ERV 405 into four zones, I, II, III and IV. The blower 415 operates to draw an airstream 435*a* from outside the enclosure 412 into zone I. The incoming air may be, for example, outside air. As used herein outside air is air that is initially external to the ERV 405 and an enclosed space (such as a building) that is environmentally conditioned by the system 400. The air stream 435*a* passes through both an intake filter 421 and the enthalpy exchange zone 425 and enters zone II. The intake filter 421 is positioned in a filter stand 422 that is located for the intake filter 421 to receive the airstream 435*a* in compartment I before passing through the enthalpy exchange zone 425. Air within zone II may exit the ERV 405 via an unreferenced outlet as an airstream 435*b*.

The ERV 405 receives an air stream 440*a* from the RTU 410 into zone III. The blower 420 draws the airstream 440*a* through an exhaust filter 426 and the enthalpy exchange zone 425 to zone IV. The air exits zone IV via an unreferenced outlet. The exhaust filter 426 is positioned in a filter stand 427 that is located for the exhaust filter 426 to receive the airstream 440*a* in compartment III before passing through the enthalpy exchange zone 425. Both the intake filter 421, the exhaust filter 426, the filter stand 422 and the filter stand 427 may be conventional components typically employed in the HVAC industry.

In some embodiments the airstreams 435*a,b* and 440*a,b* all have about an equal flow rate, e.g., $m^3$/minute. In some other embodiments the ERV 405 includes one or more bypass dampers 450 that provide a controllable path between one or more of the zones and the outside air. In such cases the air streams 435*a,b* and 440*a,b* may have different flow rates to reflect air that is drawn into or vented via the one or more dampers 450.

The ERV 405 includes pressure sensors 423, 424, 428 and 429. The pressure sensors 423, 424, 428 and 429 can be digital pressure sensors (e.g., a digital pressure switch), a pressure transducer (e.g., a differential pressure switch) or a combination thereof. The pressure sensors 423, 424, 428 and 429 provide feedback data to the controller 490. The feedback data can be used to determine predetermined conditions for, for example, the filters, 421 and 426, or for the enthalpy exchange zone 425. Additionally, the feedback data can be used to build an operation model of the ERV 405.

In the illustrated embodiment the ERV 405 is joined to the RTU 410 such that the ERV 405 provides the air stream 435*b* to an unreferenced intake of the RTU 410. The ERV 405 also receives the air stream 440*a* from the RTU 410 via an unreferenced exhaust outlet of the RTU 410.

The RTU 410 includes an economizer 455, a cooling element 460, a heating element 465 and a blower 470. The blower operates to force an air stream 475 into the building being conditioned via an unreferenced supply duct. A return airstream 480 from the building enters the RTU 410 at an unreferenced return duct.

A first portion 485 of the air stream 480 re-circulates through the economizer 455 and joins the air stream 435*b* to provide supply air to the building. A second portion of the air stream 480 is the air stream 440*a*, which enters zone III of the ERV 405.

The economizer 455 may operate conventionally to vent a portion of the return air 480 and replace the vented portion with the air stream 435*b*. Thus air quality characteristics such as $CO_2$ concentration and humidity may be maintained within defined limits within the building being conditioned.

The controller 490 may be similarly configured as the controller 200 of FIG. 2. As such, the controller 490 includes an interface 492, an operation monitor 494 and a system director 496. The operation monitor 494 and the system verifier 496 may be implemented on a processor and a memory of the controller 490. The interface 492 receives feedback data from sensors and components of the system 400 and transmits control data thereto. As such, the controller 490 may receive feedback data from the blowers 415, 420, and transmit control data thereto.

The interface 492 may be a conventional interface that employs a known protocol for communicating (i.e., transmitting and receiving) data. The interface 492 may be configured to receive both analog and digital data. The data may be received over wired, wireless or both types of communication mediums. In some embodiments, a communications bus may be employed to couple at least some of the various operating units to the interface 492. Though not illustrated, the interface 492 includes input terminals for receiving feedback data.

The operation monitor 494 determines if the feedback data corresponds to a predetermined condition for a first operating unit. In one embodiment, a controller of the RTU 410 (not shown) may be configured to provide the functionality of the controller 490 for components of the RTU.

The system director 496 is configured to operate a second operating unit of the HVAC system at a predetermined operating value corresponding to the predetermined condition and a number of occurrences of predetermined conditions associated with the first operating unit. The predetermined operating value allows the second operating unit to be operated at a reduced capacity. Advantageously, components of the HVAC system 400 can still be operated to obtain at least some benefit therefrom but yet still provide some protection for the HVAC system.

Figure 5:
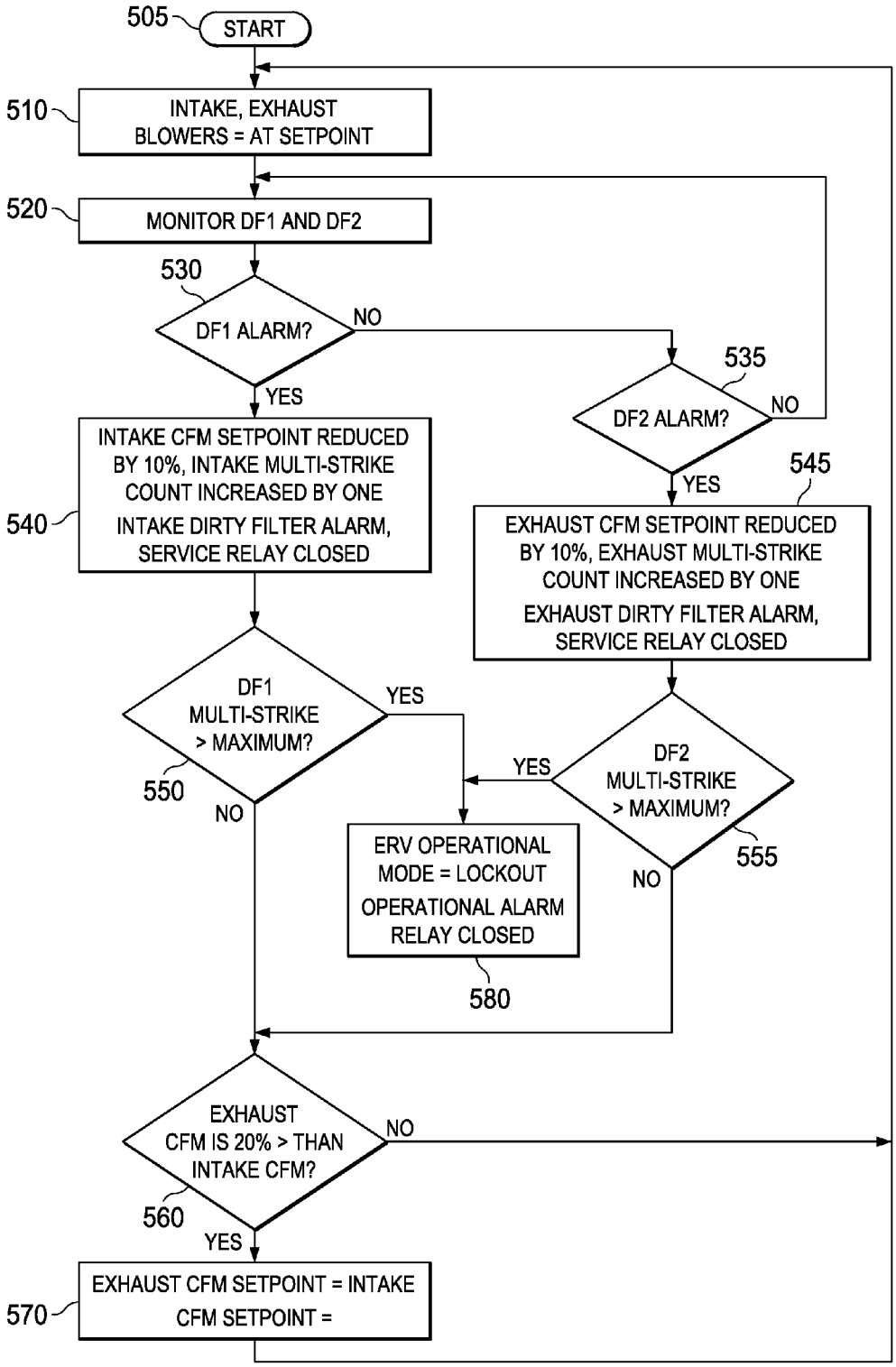
FIG. 5 illustrates a flow diagram of an embodiment of a method of operating an HVAC system carried out according to the principles of the disclosure.
Figure 6:
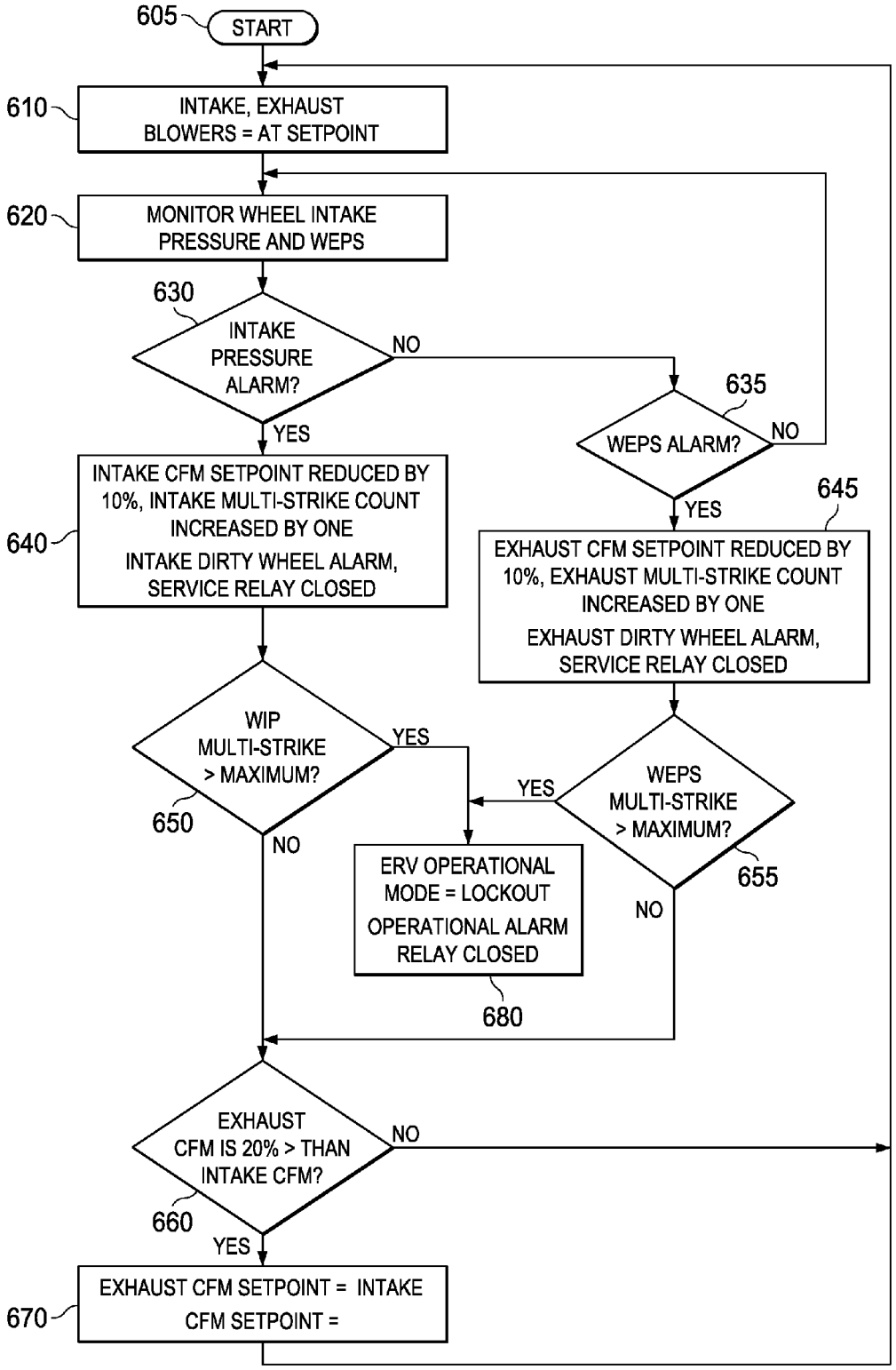
FIG. 6 illustrates a flow diagram of another embodiment of a method of operating an ERV carried out according to the principles of the disclosure.
Figure 7A:
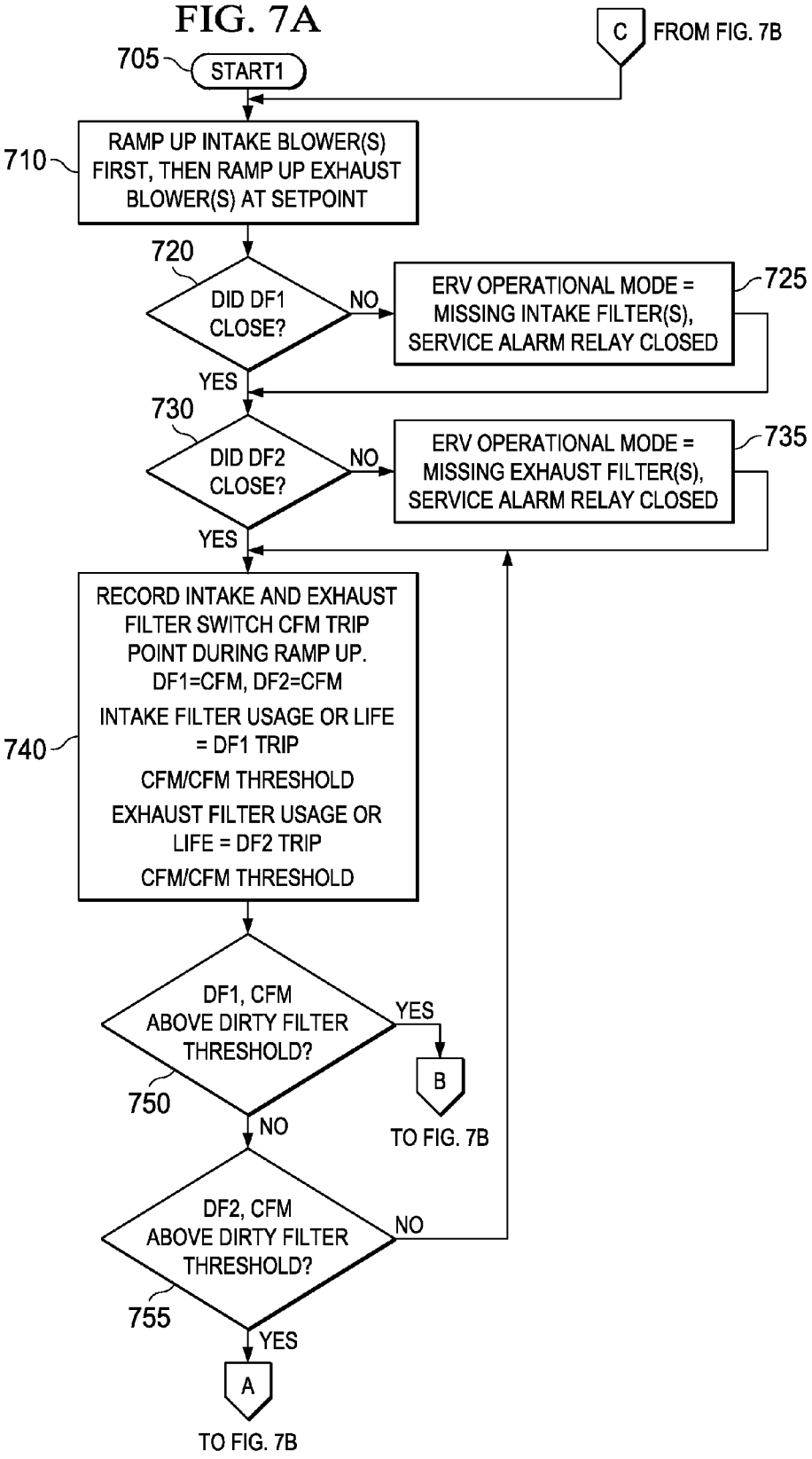
FIG. 7 illustrates a flow diagram of an embodiment of a method of operating an HVAC system carried out according to the principles of the disclosure.
Figure 7B:
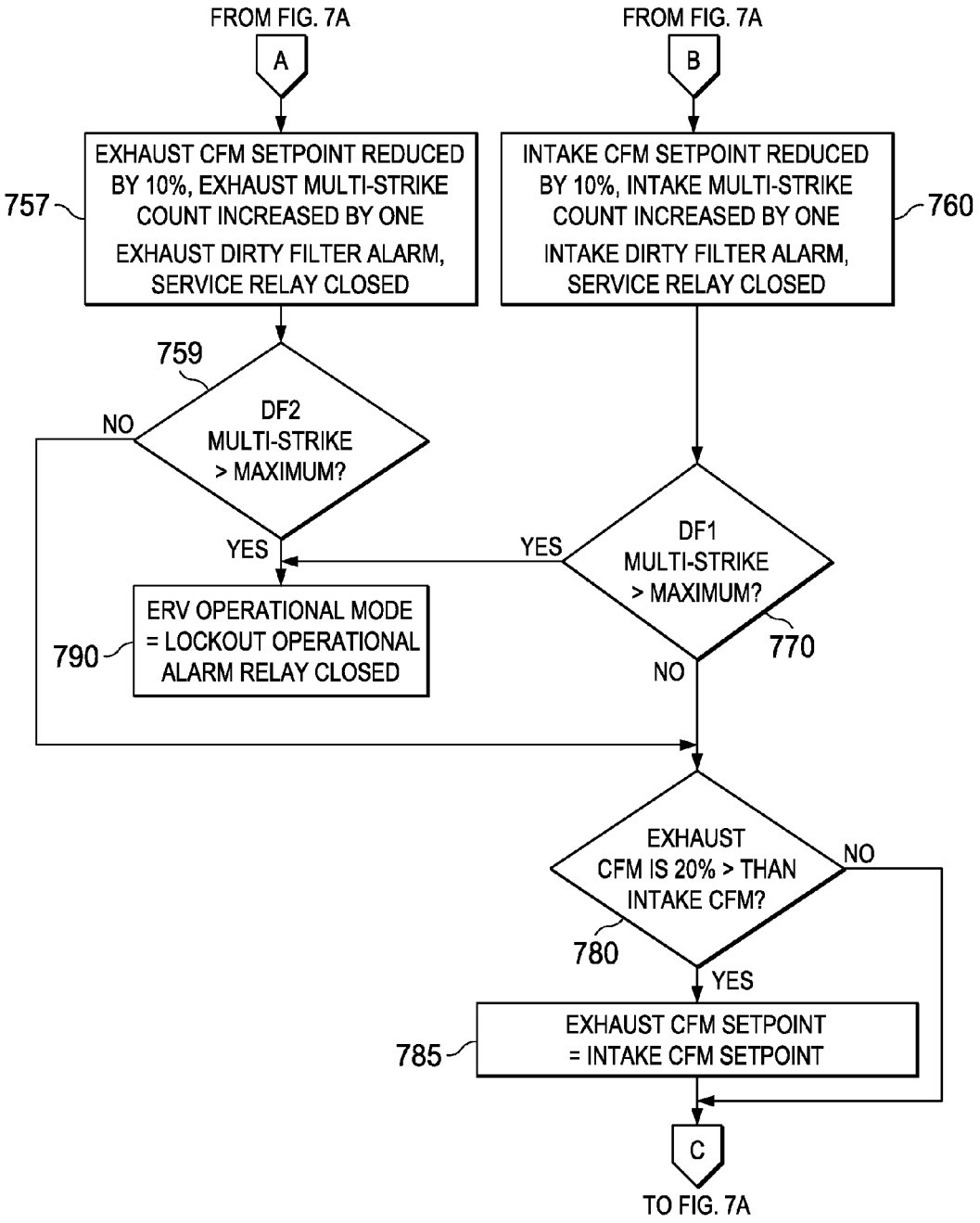

FIG. 5 through FIG. 7 illustrate examples of operating HVAC systems, such as HVAC system 400, employing predetermined conditions and corresponding predetermined operating values. For example, in FIG. 5, a dirty filter is a predetermined condition and operation of at least one operating unit, a blower, of an HVAC system is altered according to predetermined operating values corresponding to the predetermined condition. The illustrated methods in FIG. 5, FIG. 6 and FIG. 7, or at least a portion thereof, represent an algorithm that is stored on a computer readable medium, such as a memory of an HVAC controller (e.g., the memory 176 of FIG. 1) as a series of operating instructions that direct the operation of a processor (e.g., the processor 174 of FIG. 1) when initiated thereby. The illustrated operating procedures may be stored on a memory of a controller and can be accessed by a processor thereof for implementation.

FIG. 5 illustrates a flow diagram of an embodiment of a method 500 of operating an HVAC system carried out according to the principles of the disclosure. The method 500 is directed to detecting a dirty filter or dirty filters of the HVAC system and altering the operation of the HVAC system when a dirty filter is detected. The method 500 is employed with an HVAC system having two filters. In one embodiment, the HVAC system is an ERV. As such, the filters are an intake filter and an exhaust filter. The method 500, however, may be employed with other HVAC systems with two filters. One skilled in the art will understand that the method 500 can also be employed with HVAC system having a single filter that is monitored. The method 500 begins in a step 505.

In a step 510, intake and exhaust blowers of the HVAC system are operated at a set point. In one embodiment, the set points for the blowers are operating values that correspond to standard or normal operating values for particular intake and exhaust blowers. In one embodiment, a controller sends control data to direct the intake and exhaust blowers to operate at the set point.

Feedback data associated with filters of the HVAC system are monitored in a step 520. In one embodiment, the feedback data indicates a pressure drop across each of the filters. In another embodiment, the feedback data indicates an air pressure associated with each of the filters. Input terminals of a controller or input terminals associated therewith may be designated to receive the feedback data for either of the filters. As such, in one embodiment, monitoring the feedback data includes monitoring the data received at the designated input terminals. For example, a first input terminal is designated to receive feedback data for the intake filter and a second input terminal is designated to receive feedback data for the exhaust filter. In FIG. 5, DF1 and DF2 represent dirty filter 1, the intake filter, and dirty filter 2, the exhaust filter. Digital pressure sensors may provide the feedback data for dirty filter 1 and dirty filter 2.

In a first decisional step, a determination is made in step 530 if the intake filter is dirty. If not, the method 500 proceeds to a second decisional step, step 535, where a determination is made if an exhaust filter is dirty. In one embodiment, these determinations are made when the received feedback indicates a pressure drop across a filter that corresponds to a dirty filter. The controller may employ a look-up table or perform a calculation to determine if a dirty filter exists. If it is determined that the exhaust filter is not dirty, then the method 500 continues to step 520.

If a determination is made that the intake filter is dirty, the method 500 proceeds to step 540 wherein the operating capacity of the intake blower is reduced to a predetermined operating value and a number of detected dirty intake filters is increased by one. In one embodiment, the predetermined operating value is ten percent less than the CFM set point. In addition to reducing the operating capacity of the intake blower and noting the number of strikes, other actions may also be taken in response to detecting a dirty intake filter. For example, an intake dirty filter alarm can be initiated and a service relay can be closed. By closing the service relay, operation of the HVAC system can continue with the dirty intake filter.

In a third decisional step 550, a determination is made if the number of dirty intake filter detections (i.e., strikes) is greater than a set maximum number of strikes. In some embodiments, the maximum number of strikes is set to 2.

If the number of dirty intake filter strikes is not greater than the maximum, a determination is made in a fourth decisional step 560 if the exhaust CFM is twenty percent greater than the reduced intake CFM. The controller may determine this by comparing feedback data from various pressure sensors located within the HVAC system.

If so, the exhaust CFM set point is set to the reduced intake CFM set point in a step 570. At this point, the reduced intake CFM set point has been reduced according to a predetermined operating value that corresponds to a dirty intake filter strike and the number of occurrences of dirty intake filter strikes. The method 500 then continues to step 510 wherein the intake and exhaust blowers are operated according to the existing set points. If at step 560 it is determined that the exhaust CFM is not greater than the reduced intake set point, then the method 500 continues to step 510.

Returning now to decisional step 535, if a determination is made that the exhaust filter is dirty, the method 500 proceeds to step 545 wherein the operating capacity of the exhaust blower is reduced to a predetermined operating value and a number of detected dirty exhaust filters is increased by one. In one embodiment, the predetermined operating value is ten percent less than the original CFM set point for the exhaust blower. In addition to reducing the operating capacity of the exhaust blower and noting the number of strikes, other actions may also be taken in response to detecting a dirty exhaust filter. For example, an exhaust dirty filter alarm can be initiated and a service relay can be closed. By closing the service relay, operation of the HVAC system can continue with the dirty exhaust filter.

In a fifth decisional step 550, a determination is made if the number of dirty exhaust filter detections (i.e., strikes) is greater than a set maximum number of strikes. In some embodiments, the maximum number of strikes is set to 2.

If the number of dirty exhaust filter strikes is not greater than the maximum, the method proceeds to step 560. If the number of dirty exhaust filter strikes is greater than the maximum, the method continues to step 580 wherein operation of the HVAC system is stopped. In one embodiment, the operational mode of the HVAC system is set to lockout and an operational alarm relay is closed to proclaim the lockout. The method 500 also proceeds to step 580 when a determination is made in step 550 that the number of dirty intake filter strikes is greater than the maximum. At step 580, the method 500 ends. This completes the multi-strike dirty filter cycle and each counter for the number of strikes detected is reset to zero.

FIG. 6 illustrates a flow diagram of an embodiment of a method 600 of operating an ERV carried out according to the principles of the disclosure. The method 600 is directed to detecting a dirty enthalpy wheel of an ERV and altering the operation of an operating unit of the ERV when a dirty enthalpy wheel is detected. Instead of a dirty enthalpy wheel, the method 600 can be used for a dirty enthalpy exchange zone, also. Similar to the method 500, the method 600 allows operation of the ERV even when a dirty enthalpy wheel is detected. The method 600 begins in a step 605 with start-up of the ERV.

In a step 610, intake and exhaust blowers of the ERV are operated at a set point. In one embodiment, the set points for the blowers are operating values that correspond to standard or normal operating values for particular intake and exhaust blowers. In one embodiment, a controller sends control data to direct the intake and exhaust blowers to operate at the set point.

Feedback data representing air pressure associated with the enthalpy wheel is monitored in a step 620. In one embodiment, the feedback data represents the intake pressure and the exhaust pressure for the ERV. In some embodiments, an intake pressure transducer and an enthalpy wheel exhaust pressure switch provide the feedback data that is monitored. Input terminals of a controller or input terminals associated therewith may be designated to receive the feedback data. As such, in one embodiment, monitoring the feedback data includes monitoring the data received at the designated input terminals. For example, a first input terminal is designated to receive feedback data for the intake pressure and a second input terminal is designated to receive feedback data for the exhaust pressure.

In a first decisional step 630, a determination is made if the intake pressure has reached a predetermined condition. If not, the method 600 proceeds to a second decisional step, step 635, where a determination is made if an exhaust pressure has reached a predetermined condition. As indicated in FIG. 6, in one embodiment a wheel exhaust pressure switch (WEPS) can be employed to determine if the exhaust pressure has reached a predetermined condition. In one embodiment, these determinations are made when the received feedback corresponds to a pressure that indicates a dirty enthalpy wheel. Thus, the predetermined conditions for steps 630 and 635 in these embodiments are air pressure values. A look-up table based on historical data or calculations may be used for these determinations. If it is determined that the exhaust pressure is not at a predetermined condition, then the method 600 continues to step 620.

If a determination is made that the intake pressure is at a predetermined condition, the method 600 proceeds to step 640 wherein the operating capacity of the intake blower is reduced to a predetermined operating value and a number of strikes for intake pressure alarms is increased by one. In one embodiment, the predetermined operating value is ten percent less than the CFM set point. In addition to reducing the operating capacity of the intake blower and noting the number of strikes, other actions may also be taken in response to the occurrence of a predetermined condition. For example, an intake dirty wheel alarm can be initiated and a service relay can be closed. By closing the service relay, operation of the HVAC system can continue with the dirty wheel.

In a third decisional step 650, a determination is made if the number of intake pressure strikes is greater than a set maximum number of strikes. In some embodiments, the maximum number of strikes is set to 3. The maximum number of strikes can be based on the amount of capacity reduction that is employed whenever a strike occurs. As an example, if capacity is reduced by five percent with the occurrence of each strike the maximum number of strikes can be set to four. In comparison, if capacity is reduced by ten percent with the occurrence of each strike, then the maximum number of strikes can be set to two. In one embodiment, the maximum number of strikes is a field adjustable parameter and can be changed to any value from zero, which indicates the multi-strike feature is turned-off, to ten.

If the number of intake pressure strikes is not greater than the maximum, a determination is made in a fourth decisional step 660 if the exhaust CFM is twenty percent greater than the reduced intake CFM. The controller may determine this by comparing feedback data from various pressure sensors located within the HVAC system.

If so, the exhaust CFM set point is set to the reduced intake CFM set point in a step 670. At this point, the reduced intake CFM set point has been reduced according to a predetermined operating value that corresponds to a dirty intake filter strike and the number of occurrences of dirty intake filter strikes. The method 600 then continues to step 610 wherein the intake and exhaust blowers are operated according to the existing set points. If at step 660 it is determined that the exhaust CFM is not greater than the reduced intake set point, then the method 600 continues to step 610.

Returning now to decisional step 635, if a determination is made that a predetermined condition exists for the exhaust pressure, the method 600 proceeds to step 645 wherein the operating capacity of the exhaust blower is reduced to a predetermined operating value and a number of exhaust pressure strikes is increased by one. In one embodiment, the predetermined operating value is ten percent less than the original CFM set point for the exhaust blower. In addition to reducing the operating capacity of the exhaust blower and noting the number of strikes, other actions may also be taken in response to detecting the occurrence of an exhaust pressure predetermined condition. For example, an exhaust dirty wheel alarm can be initiated and a service relay can be closed.

In a fifth decisional step 655, a determination is made if the number of exhaust pressure strikes is greater than a set maximum number of strikes. If so, the method 600 proceeds to step 660. If not, the method 600 continues to step 580 wherein operation of the ERV is stopped. In one embodiment, the operational mode of the ERV is set to lockout and an operational alarm relay is closed to proclaim the lockout. The method 600 also proceeds to step 680 when a determination is made in step 650 that the number of intake pressure strikes is greater than the maximum. At step 680, the method 600 ends. This completes the multi-strike dirty wheel cycle and each counter for the number of strikes detected is reset to zero.

FIG. 7 illustrates a flow diagram of an embodiment of a method 700 of determining a filter life of an HVAC system carried out according to the principles of the disclosure. The method 700 is directed to employing feedback data to determine the life of a filter. The feedback data represents air pressure associated with the filter. In one embodiment, the HVAC system is an ERV. As such, a filter is an intake filter or an exhaust filter. The method 700 is incorporated with a multi-strike dirty filter method as illustrated in FIG. 5. The method 700 begins in a step 705 with start-up of the HVAC system.

In a step 710, intake blowers and exhaust blowers are ramped-up to a set point in order. In the method 700, the intake blower is ramped-up first and then the exhaust blower. A determination is made in a first decisional step 720 if feedback data indicates the intake pressure of the HVAC system reached a designated operating value. In one embodiment, the designated operating value (a predetermined condition) is a low air pressure value that corresponds to the pressure drop across a filter. In one embodiment, the feedback data is provided via a differential pressure switch. In another embodiment, the feedback data is provided by a digital pressure switch. The low air pressure value is selected to occur during ramp-up of the intake blower when an intake filter is installed. Accordingly, if the intake pressure has not reached the designated operating value, notification of a missing intake air filter is performed in a step 725. In some embodiments, a predetermined operating mode for a missing intake filter is initiated and/or a service alarm relay is closed.

After step 725 and if the feedback data indicates the intake pressure of the HVAC system reached a designated operating value, the method 700 continues to second decisional step 730 where a determination is made if feedback data indicates the exhaust pressure of the HVAC system reached a designated operating value. The designated operating value corresponds to a low air pressure value that is selected to occur during ramp-up of the intake blower when an intake filter is installed. In one embodiment, the designated operating value for the exhaust pressure is the same as the designated operating value for the intake pressure. As with the intake pressure, the feedback data can be provided, for example, via a differential pressure switch or a digital pressure switch. Accordingly, if the intake pressure has not reached the designated operating value, notification of a missing exhaust air filter is performed in a step 735. In some embodiments, a predetermined operating mode for a missing exhaust filter is initiated and/or a service alarm relay is closed.

After step 735 and if the feedback data indicates the exhaust pressure of the HVAC system reached a designated operating value, the method 700 continues to step 740 where the blower speed of the intake blower and exhaust blower are recorded that corresponds to the occurrences of the intake pressure and the exhaust pressure reaching the designated operating values. Thus, when the method 700 detects pressure across a filter has reached the low set point, the blower speed of the appropriate blower that produced enough pressure drop to close the switch is recorded in step 740. A comparison is then made in step 740 between the blower speed and the measured pressure drop across the enthalpy wheel to determine the approximate CFM that was flowing through the ERV when the designated operating value occurred (e.g., a filter pressure switch tripped). Commissioning CFM data and/or internal pre-programmed pressure-drop to CFM tables to determine how the HVAC filter compares to a brand new clean filter can be employed to determine the filter life of the filter. The comparison will determine how much of the filter life has been consumed by current operation of the ERV in hours and/or days and to have a good estimate on how much longer the unit will be able to operate in days and/or hours before the filter needs to be changed. As such, intelligent filter usage can be obtained.

After determining the filter life, the method 700 continues similar to the method 500. In a third decisional step 750, a determination is made if the intake filter is dirty. If not, the method 700 proceeds to a second decisional step, step 755, where a determination is made if an exhaust filter is dirty. If not, the method continues to step 740.

If a determination is made that the intake filter is dirty, the method 700 proceeds to step 760 wherein the operating capacity of the intake blower is reduced to a predetermined operating value and a number of detected dirty intake filters is increased by one. In addition to reducing the operating capacity of the intake blower and noting the number of strikes, other actions may also be taken in response to detecting a dirty intake filter.

In a fifth decisional step 770, a determination is made if the number of dirty intake filter strikes is greater than a set maximum number of strikes. If the number of dirty intake filter strikes is not greater than the maximum, a determination is made in a sixth decisional step 780 if the exhaust CFM is twenty percent greater than the reduced intake CFM. If so, the exhaust CFM set point is set to the reduced intake CFM set point in a step 785. At this point, the reduced intake CFM set point has been reduced according to a predetermined operating value that corresponds to a dirty intake filter strike and the number of occurrences of dirty intake filter strikes. The method 700 then continues to step 710 wherein the intake and exhaust blowers are operated according to the existing set points. If at step 780 it is determined that the exhaust CFM is not greater than the reduced intake set point, then the method 700 continues to step 710.

Returning now to decisional step 755, if a determination is made that the exhaust filter is dirty, the method 700 proceeds to step 757 wherein the operating capacity of the exhaust blower is reduced to a predetermined operating value and a number of detected dirty exhaust filters is increased by one. In addition to reducing the operating capacity of the exhaust blower and noting the number of strikes, other actions may also be taken in response to detecting a dirty exhaust filter.

In a seventh decisional step 759, a determination is made if the number of dirty exhaust filter strikes is greater than a set maximum number of strikes. If the number of dirty exhaust filter strikes is not greater than the maximum, the method proceeds to step 780. If the number of dirty exhaust filter strikes is greater than the maximum, the method continues to step 790 wherein operation of the ERV is stopped. In one embodiment, the operational mode of the ERV is set to lockout and an operational alarm relay is closed to proclaim the lockout. The method 700 also proceeds to step 780 when a determination is made in step 770 that the number of dirty intake filter strikes is greater than the maximum. At step 790, the method 700 ends. This completes the multi-strike dirty filter cycle and each counter for the number of strikes detected is reset to zero.

Those skilled in the art to which this application relates will appreciate that other and further additions, deletions, substitutions and modifications may be made to the described embodiments.

What is claimed is:

1. A controller for a heating, ventilating and cooling (HVAC) system, comprising:

an input terminal configured to receive feedback data from a pressure sensor associated with a first operating unit of said HVAC system;

an operation monitor configured to determine if said feedback data corresponds to a predetermined condition for said first operating unit, said predetermined condition being one of a group consisting of: a dirty enthalpy wheel and a dirty filter; and a processor comprising a system director, in response to the determination that said feedback data corresponds to said predetermined condition, configured to:

determine a number of occurrences of predetermined conditions associated with said first operating unit;

determine whether the number of occurrences of predetermined conditions is greater than a first threshold;

in response to determining that the number of occurrences of predetermined conditions is not greater than the first threshold, operate a fan blower of said HVAC system at a predetermined operating value, said predetermined operating value corresponding to the number of occurrences of predetermined conditions associated with said first operating unit; and in response to determining that the number of occurrences of predetermined conditions is greater than the first threshold, turn off the fan blower.

2. The controller as recited in claim 1 wherein said predetermined condition corresponds to a pre-set operating value for said first operating unit.

3. The controller as recited in claim 1 wherein said predetermined operating value reduces an operating capacity of said fan blower.

4. The controller as recited in claim 3 wherein said operating capacity is reduced to a first limited operating value when said number of occurrences is equal to one and reduced to a second limited operating value when said number of occurrences is equal to two.

5. The controller as recited in claim 1 wherein said predetermined operating value prevents operation of said fan blower.

6. The controller as recited in claim 1 wherein said HVAC system is an energy recovery ventilator and said feedback data is a designated input selected from the list consisting of:

a dirty enthalpy wheel input, and a dirty filter switch input.

7. The controller as recited in claim 6 wherein said operation monitor is further configured to employ said feedback data to determine a filter life value for a filter of said energy recovery ventilator corresponding to a dirty filter switch input.

8. The controller as recited in claim 1 wherein said system director is further configured to generate an alarm based on said predetermined condition.

9. A non-transitory computer-usable medium having computer readable instructions stored thereon for execution by a processor to perform a method for operating a heating, ventilating and cooling (HVAC) system, comprising:

receiving feedback data from a pressure sensor associated with a first operating unit of said HVAC system;

determining if said feedback data corresponds to a predetermined condition for said first operating unit, said predetermined condition being one of a group consisting of: a dirty enthalpy wheel and a dirty filter; and in response to the determination that said feedback data corresponds to said predetermined condition:

determining a number of occurrences of predetermined conditions associated with said first operating unit;

determining whether the number of occurrences of predetermined conditions is greater than a first threshold;

in response to determining that the number of occurrences of predetermined conditions is not greater than the first threshold, operating a fan blower of said HVAC system at a predetermined operating value, the predetermined operating value corresponding to the number of occurrences of predetermined conditions associated with said first operating unit; and in response to determining that the number of occurrences of predetermined conditions is greater than the first threshold, turn off the fan blower.

10. The computer-usable medium as recited in claim 9 wherein said predetermined condition corresponds to a pre-set operating value for said first operating unit.

11. The computer-usable medium as recited in claim 9 wherein said predetermined operating value reduces an operating capacity of said fan blower.

12. The computer-usable medium as recited in claim 11 wherein said operating capacity is reduced to a first limited operating value when said number of occurrences is equal to one and reduced to a second limited operating value when said number of occurrences is equal to two.

13. The computer-usable medium as recited in claim 9 wherein said predetermined operating value prevents operation of said fan blower.

14. The computer-usable medium as recited in claim 9 wherein said HVAC system is an energy recovery ventilator and said feedback data is a designated input selected from the list consisting of:

a dirty enthalpy wheel input, and a dirty filter switch input.

15. The computer-usable medium as recited in claim 14 wherein said operation monitor is further configured to employ said feedback data to determine a filter life value for a filter of said energy recovery ventilator corresponding to a dirty filter switch input.

16. The computer-usable medium as recited in claim 9 wherein said system director is further configured to generate an alarm based on said predetermined condition.

17. An energy recovery ventilator, comprising:

a filter;

an enthalpy wheel;

a fan that moves air through said filter and said enthalpy wheel; and a controller including:

a first input terminal configured to receive feedback data from a pressure sensor associated with said air moving through said filter;

an operation monitor configured to determine if said feedback data corresponds to a dirty filter predetermined condition for said filter; and a system director in response to the determination that said feedback data corresponds to said predetermined condition, configured to:

determine a number of occurrences of predetermined conditions associated with said first operating unit;

determine whether the number of occurrences of predetermined conditions is greater than a first threshold;

in response to determining that the number of occurrences of predetermined conditions is not greater than the first threshold, operate said fan at a filter predetermined operating value, said filter predetermined operating value corresponding to a number of occurrences of dirty filter predetermined conditions associated with said filter; and in response to determining that the number of occurrences of predetermined conditions is greater than the first threshold, turn off the fan.

18. The energy recovery ventilator as recited in claim 17 further comprising a second input terminal configured to receive additional feedback data corresponding to said air moving through said enthalpy wheel, wherein said operation monitor is further configured to determine if said additional feedback data corresponds to a dirty wheel predetermined condition for said enthalpy wheel and said system director is further configured to operate said fan at a wheel predetermined operating value in response to the determination that the feedback data corresponds to said dirty wheel predetermined condition, said wheel predetermined operating value corresponding to a number of occurrences of wheel predetermined conditions associated with said enthalpy wheel.

* * * * *